US005713823A

United States Patent [19]

Walendzak et al.

[11] Patent Number: 5,713,823

[45] Date of Patent: Feb. 3, 1998

[54] THERAPEUTIC EXERCISE DEVICE FOR THE SHOULDER

[76] Inventors: Donald R. Walendzak, 3913 Sheffield Ct., Toledo, Ohio 43623; Brooks H. Millar, 12605 Miller Rd., Rapid City, Mich. 49676

[21] Appl. No.: 754,020

[22] Filed: Nov. 20, 1996

[51] Int. Cl.[6] ..... A63B 26/00; A63B 71/00

[52] U.S. Cl. ..... 482/142; 482/148; 482/139; 482/141

[58] Field of Search ..... 482/139, 141, 482/146, 147, 148, 126, 127; 472/135, 14, 26; 446/7, 227, 46, 47, 48, 450, 452; 273/425

[56] References Cited

U.S. PATENT DOCUMENTS

| | | | |
|---|---|---|---|
| D. 278,924 | 5/1985 | Seel et al. . | |
| D. 321,387 | 11/1991 | Jones . | |
| 3,604,722 | 9/1971 | Boley | 280/87.01 |
| 3,784,195 | 1/1974 | Johnson . | |
| 4,193,592 | 3/1980 | Bishow | 492/14 |
| 4,203,591 | 5/1980 | Gibson . | |
| 4,569,519 | 2/1986 | Mattox et al. . | |
| 4,603,856 | 8/1986 | Fiore . | |
| 4,610,448 | 9/1986 | Hill | 482/141 |
| 4,653,748 | 3/1987 | Seel et al. . | |
| 4,733,860 | 3/1988 | Steffee . | |
| 4,757,992 | 7/1988 | Heitsch et al. . | |
| 4,817,943 | 4/1989 | Pipasik . | |
| 4,986,534 | 1/1991 | Meier et al. . | |
| 4,988,098 | 1/1991 | Miller . | |
| 5,002,272 | 3/1991 | Hofmeister | 482/127 |
| 5,096,190 | 3/1992 | Montgomery . | |
| 5,179,939 | 1/1993 | Donovan et al. . | |
| 5,306,223 | 4/1994 | Matinez | 482/142 |
| 5,336,138 | 8/1994 | Arjawat . | |
| 5,352,174 | 10/1994 | Mason et al. . | |
| 5,498,223 | 3/1996 | Iams et al. . | |
| 5,549,536 | 8/1996 | Clark | 482/146 |

FOREIGN PATENT DOCUMENTS

| | | | |
|---|---|---|---|
| 3011785 | 10/1980 | Germany | 482/146 |

*Primary Examiner*—Richard J. Apley
*Assistant Examiner*—William LaMarca
*Attorney, Agent, or Firm*—Brinks Hofer Gilson & Lione

[57] ABSTRACT

A mechanical device for exercising selected muscle/skeletal groups in the shoulder region of a user. The device includes a round frame with a support member for stability. A pivot ball is mounted on the underside of the support member at the center of the round frame. Handles are mounted on the upper surface of the support member. A user grasps the handles and then rotates/nutates the device about the pivot ball to exercise the shoulder region and related muscles. Three separate handle assemblies may be used to isolate different muscle/skeletal groups of a user and/or vary the difficulty of the exercise: a standard handle assembly, an isolator assembly, and an angled handle assembly.

12 Claims, 2 Drawing Sheets

THERAPEUTIC EXERCISE DEVICE FOR THE SHOULDER

BACKGROUND

I. Field of the Invention

This invention is in the general field of exercising for physical rehabilitation, strength, and muscle development. More particularly, the present invention relates to a shoulder complex (including the glenohumeral and scapulothoracic joints) exercising device which provides a variety of options for isolating selected skeletal/muscle groups of a user, as well as affecting the trunk musculature (including the abdominal, back, and hip muscles as they relate to the shoulder complex).

II. Description of the Related Art

A myriad of exercise equipment has been developed over the years. This equipment is often directed to exercising and strengthening specific muscle groups, including the shoulder area. Most devices, however, involve a number of moving parts and can be quite complicated to operate, often requiring the training and continued assistance of a fitness professional or physical therapist. For example, U.S. Pat. No. 4,569,519, issued to Mattox, et al., discloses a shoulder exercising apparatus involving a piston-like exercise bar which is spring loaded. Similarly, U.S. Pat. No. 4,988,098, issued to Miller, teaches a free-standing machine which utilizes a complex weight and pulley system.

With regard to the rehabilitation of a patient, a concept known as "controlled instability" is a key technique. Controlled instability minimizes the stresses to injured muscle/skeletal structures initially and then functionally progresses those stresses when patient tolerance is reached.

For the foregoing reasons, there is a need for a simple device which allows a user to exercise and strengthen the shoulder area without having to continually relying on the expertise of others or spend large sums of money on expensive equipment. Furthermore, there is a need for an exercise device which utilizes the latest techniques, i.e., controlled instability, to give a patient the best rehabilitation possible with minimal risk of reinjury.

SUMMARY

The present invention relates to a device for exercising the shoulder area of a user while also involving the trunk and hip muscles related to the shoulder area. The device is made of a round frame with a support member dividing the frame in half. The support member provides overall stability to the frame and also serves as a base for a variety of handle assemblies which are used in various combinations. The support member has a number of holes in its upper surface to receive the mounting pegs attached to each handle assembly. Attached to the bottom surface of the support member in the center of the frame is a pivot ball. The basic exercise is performed as the user grips the handle assemblies and then rotates/nutates the frame about the pivot ball. The user can progressively improve muscle strength by increasing the weight bearing position in which the invention is used, utilizing the different handle configurations, and varying the size of the pivot ball.

Accordingly, it is an object of the present invention to provide simple, effective device for exercising the muscles of a user, including the hips, trunk, and primarily the shoulder area.

It is a further object of the present invention to provide the above-described exercise device which does not require the continual attention of a physical therapist or fitness professional.

It is a yet further object of the present invention to provide a portable, cost effective means of strengthening and rehabilitating the shoulder area of a user.

For a further understanding of the present invention and the objects thereof, attention is directed to the drawings and the following brief description thereof, to the detailed description, and to the appended claims.

DETAILED DESCRIPTION

Figure 1:
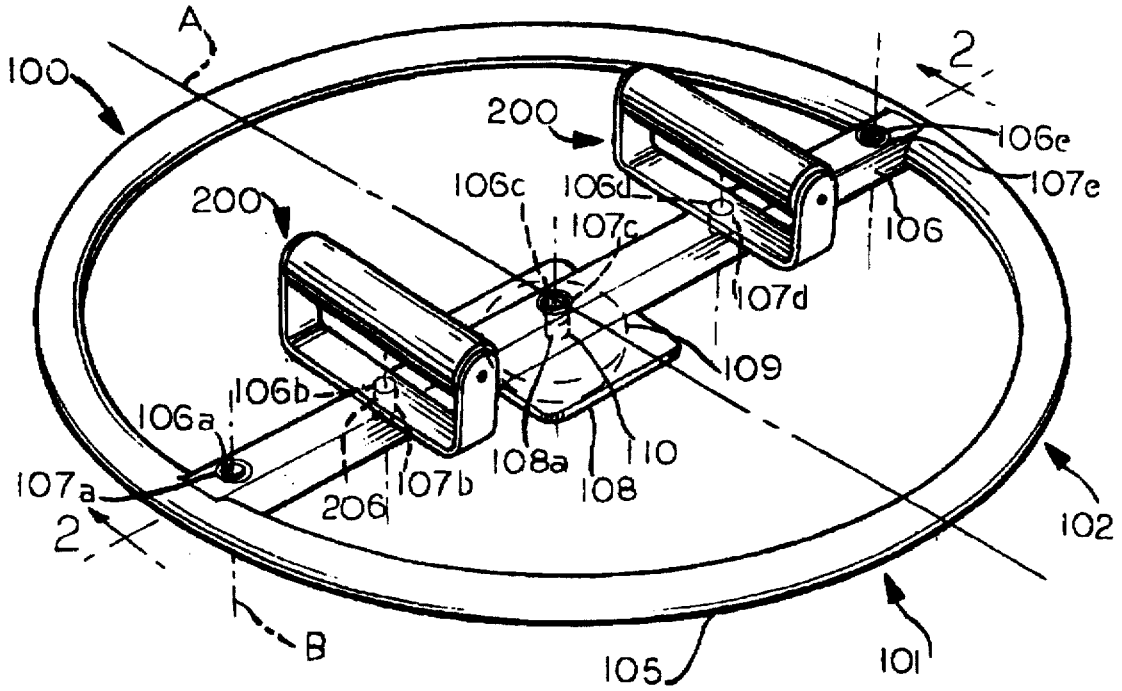
FIG. 1 is a perspective view of the preferred embodiment of the present invention.
Figure 2:
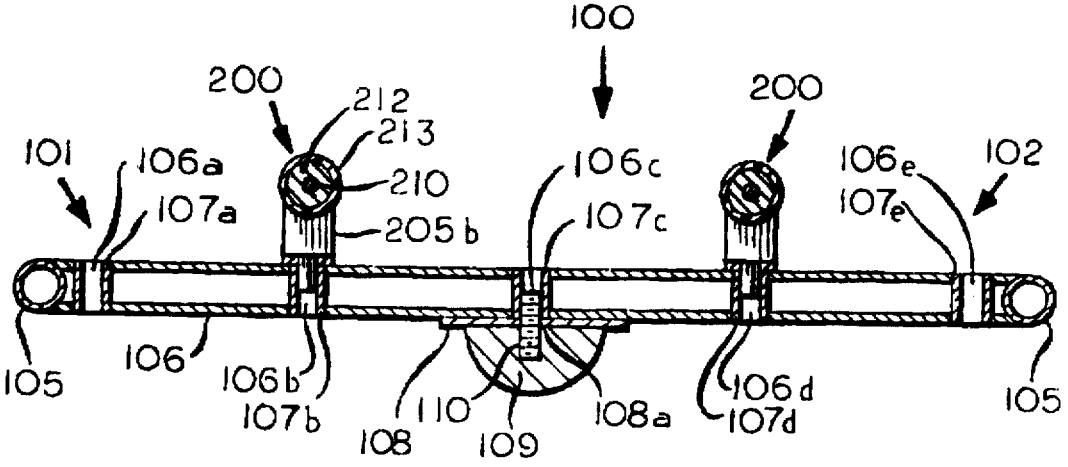
FIG. 2 is a section view along line 2—2.

The construction of the preferred embodiment is a follows. The frame 105 of exercising device 100, as shown in FIGS. 1 and 2, is made from a sturdy metal, such as steel or the like, and is round in cross-sectional shape. However, a high density plastic, composite material, or even wood could also be used provided sufficient tensile strength and load bearing capability could be obtained. Accordingly, the frame 105 need not be hollow, but may be solid or partially filled. The frame 105 is generally circular in shape for the preferred embodiment, but could be one of any number of geometric shapes. The exercising device 100 is divided into a left half 101 and a right half 102, as depicted by the dividing line A in FIG. 1. A support member 106 is attached to left and right halves 101 and 102 as shown in FIGS. 1 and 2. The support member 106 may be made of a material identical to that of the frame 105, or may be of a different, structurally sufficient, material. The support member 106 is attached to the frame 105 such that it passes through the center of a circle formed by the frame 105, whereby forming a diameter to the circle. The method of choice for attaching the support member 106 to the frame 105 is welding, but may also be an equivalent means of attaching such as bolting, screwing, riveting or the like. Along the length of the support member 106 are holes 106*a*–106*e* which are oriented about vertical axes B, shown in FIG. 1. Bushings 107*a*–107*e* are located within the holes 106*a*–106*e*, respectively, and are used to receive mounting pegs 206, 306, or 406 of handle assemblies 200, 300, and 400, respectively, to be described in further detail later herein. The holes 106*a*–106*e* may be formed completely through the support member 106 as shown in FIGS. 1 and 2, or may be formed only to a depth sufficient to accommodate mounting pegs 206, 306, and 406. Attached to the underside of the support member 106 is a support plate 108 which is made of a generally flat sheet of metal and is substantially square in shape for the preferred embodiment. The support plate 108 has a threaded hole 108*a* formed therethrough which aligns with the vertical axis B of support member hole 106*c*. A pivot ball 109 contains a threaded rod 110 which engages the threaded hole 108*a*, allowing the pivot ball 109 to be screwed tightly against the support plate 108. It is not necessary that the threaded rod 110 partially extends up into support member hole 106*c*, but it is acceptable if it does so. The pivot ball 109 generally has a partial sphere shape and is typically made of hardened rubber or like material to prevent slippage of the exercise device 100 when placed on a surface (not shown).

The exercise device 100 may be utilized with any one of at least three separate handle configurations, each of which allows the user to perform different functions using the same basic device 100 and also allows the device 100 to be adjusted to fit users of different body sizes and shapes.

Figure 3:
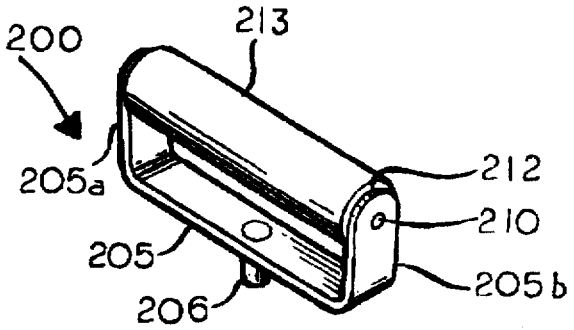
FIG. 3 is a perspective view of the standard handle assembly of the invention.

The first handle configuration utilizes a pair of identical standard handle assemblies 200 as shown in FIG. 3. They may be constructed of a material similar to or identical to that of the frame 105 and the support member 106. Each standard handle assembly 200 includes a bracket 205 which is elongate in nature having two upturned ends 205*a* and 205*b*. The bracket 205 has a mounting peg 206 fixed to the underside of the bracket 205 by welding or an equivalent method of attachment. A handle member 212 is held in place between the upturned ends 205*a* and 205*b* by bolt 210 and nut (not shown). The handle member 212 is cylindrical in the preferred embodiment, but could be other shapes. For example, the handle member 212 could have a hexagonal or octagonal cross-section. The handle member 212 may be made of a material similar to that of the frame 105 and support member 106, or any other suitable material. The handle member 212 is covered with a grip 213 made of foam or other cushioning material to maximize the comfort of the user. There are normally two standard handle assemblies 200 in use simultaneously, one mounted in the left half 101 of the device 100 and one mounted in the right half 102. The mounting peg 206 of one standard handle assembly 200 engages, for example, the bushing 107*b* located within support member hole 106*b* while the mounting peg 206 of the other standard handle assembly 200 engages the bushing 107*d* located within support member hole 106*d*, as shown in FIG. 1. This method of mounting the standard handle assemblies 200 allows for full 360° rotation as well as easy removal for standard handle assembly 200 replacement. Of course, the mounting pegs 206 of the standard handle assemblies 200 could also engage bushings 107*a* and 107*e* of holes 106*a* and 107*e*, respectively, if a situation required that the handle assemblies 200 be spaced farther apart.

Figure 4:
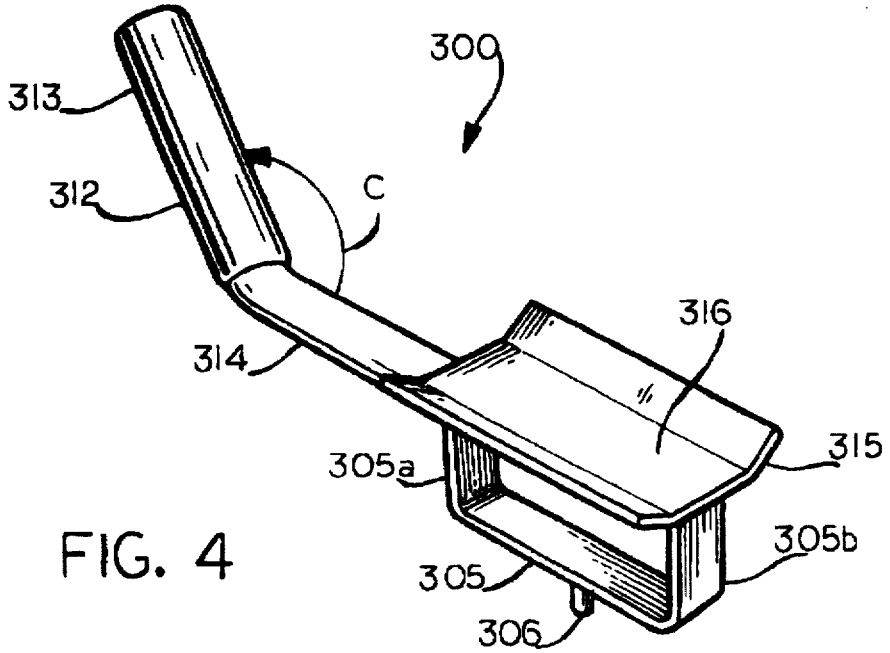
FIG. 4 is a perspective view of the isolator assembly of the invention.

The second handle configuration utilizes a pair of identical isolator assemblies 300 as shown in FIG. 4 in lieu of the standard handle assemblies 200. Each isolator assembly 300 utilizes a bracket 305 and mounting peg 306 similar to or identical to that of the standard handle assemblies 200. A handle extension 314, tubular in construction for the preferred embodiment, is fixed to each upturned end 305*a* and 305*b* of bracket 305 by welding or an equivalent attachment process. An isolator handle member 312 is located at the end of the handle extension 314 and may be formed as an integral part of the isolator handle extension 314 or may be constructed in a manner similar to that of standard handle member 212. The isolator handle member 312 is positioned at an optimum angle C of 120° from a horizontal plane, also shown in FIG. 4, but may be varied in construction to accommodate the different physiology of a particular user or other unforeseen situations which would require a different angle C. The isolator handle member 312 is covered with a foam grip 313 to maximize the comfort of the user. An isolator cradle 315 is mounted on top of the isolator handle extension 314 directly above bracket 305 using, again, a welding process or equivalent. The isolator cradle 315 is made from a flat, generally rectangular sheet of metal or other suitable material and has its longitudinal edges flared upward, best shown in FIG. 4, to prevent the user's forearm from slipping from the cradle 315. The isolator cradle 315 has a cushion 316 of foam rubber or the like fixed to it's top surface to protect the user's forearm from the hardness of the isolator cradle 315.

Figure 5:
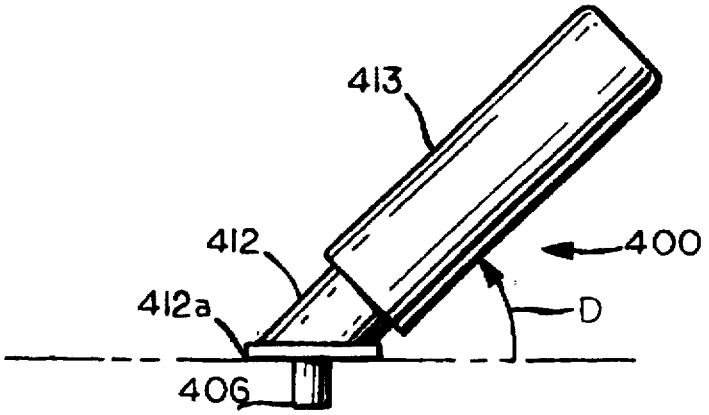
FIG. 5 is a perspective view of the angled handle assembly of the invention.

Shown in FIG. 5, the third handle configuration of the exercise device 100 utilizes an angled handle assembly 400. An angled handle base 412*a* is attached to an angled handle member 412 to provide stability and to maintain the angled handle member 412 at an optimum performance angle D of 45° to a horizontal plane. A mounting peg 406 is attached to the underside of the angled handle base 412*a* and is used to mount the angled handle assembly 400 to the support member 106 by engaging the bushing 107*c* within the hole 106*c*. While the angled handle assembly 400 is typically used by itself, there is no reason that a pair of angled handle assemblies 400 could not be used in a manner similar to the pair of standard handle assemblies 200 and isolator handle assemblies 300.

The basic operation of the exercise device 100 is as follows. The device 100 is placed on a dry, horizontal surface (not shown) such as a table or floor. The user grips the handle assemblies, 200, 300, or 400 and then slowly rotates/nutates the device 100 in a generally circular motion about the pivot ball 109. The circular motion may be defined by and safely limited by allowing the time 105 to touch the horizontal surface as the exercise device 100 is rotated/nutated about the pivot ball 109, or, the user can attempt to prevent the frame 105 from touching the surface (not shown), adding another level of difficulty.

One factor for controlling the difficulty of the exercise is the weight bearing position. Obviously, the more body weight borne by the user, the more the muscles will be exercised. For example, a beginner may start by placing the exercise device 100 on a table or bench (not shown) approximately waist high and standing to perform the exercise. This position minimizes the body weight borne by the user, and is a typical starting point for a user in the early stages of rehabilitation device or for a beginning user. A user demonstrating mastery of a lighter weight-bearing position would next place the exercise device 100 on the floor (not shown) and assume a kneeling position to perform the exercise. In this position, the user is utilizing the weight of his or her upper body to increase the stress on the shoulder area muscles. For an advanced user, a push-up position would be utilized where the user would be utilizing virtually all of his or her body weight to exercise the muscles.

Another factor for controlling the difficulty of the exercise is the size of the pivot ball 109. A relatively small pivot ball 109 would limit the range of motion because the distance between the bottom of the frame 105 and the horizontal surface would also be relatively small. However, by increasing the size of the pivot ball 109, that is, increasing the distance between the bottom of the frame 105 and the horizontal surface (not shown), the range of motion of the exercise device 100 would be also be increased, thus increasing both the range of movement of the shoulder muscles and the amount of muscle activity needed to control the exercise device 100.

The final factor in controlling the difficulty of the exercise is the handle configuration chosen. By using the angled handle assembly 400, either singly or in pairs, the 45° angle D, as shown in FIG. 5, dictates that the least amount of stress be applied to the shoulder muscles. The standard handle assembly 200, shown in FIG. 3, increases the difficulty of the exercise because the weight bearing force is directed at a 90° angle with respect to the exercise device 100. In contrast, the isolator assembly 300 exercises the shoulder muscles to the fullest. By placing the forearms of the user in the isolator cradle 316 and grasping the isolator handle member 312, the use of the muscles in the hands and wrists is minimized. By minimizing the hand and wrist movement from the exercise, the shoulder muscles are isolated and thus forced to perform almost the entire amount of work necessary to rotate/nutate the exercise device 100 about the pivot ball 109.

Although the best mode contemplated by the inventors for carrying out the present invention as of the filing date hereof has been shown and described herein, it will be apparent to those skilled in the art that suitable modifications, variations, and equivalents may be made without departing from the scope of the invention, such scope being limited solely by the terms of the following claims.

What is claimed is:

1. A device for developing and retraining the muscular and neurological physiology of the shoulder complex and related muscles of a user, said device having a left half and a right half, said device comprising:

a frame; said time forming a circle;

a support member, said support member having an upper surface and a lower surface; said support member being attached to said left half of said device and further being attached to said right half of said device whereby forming a diameter to the circle formed by said frame, said support member having at least two holes therethrough located in the left half of said device, said support member further having at least two holes therethrough located in the right half of said device, said support member still further having one hole therethrough located at the center of the circle formed by said frame;

a first handle, said first handle having a first mounting peg, said first mounting peg for engaging one of said at least two holes located in said left half of said device;

a second handle, said second handle having a second mounting peg, said second mounting peg for engaging one of said at least two holes located in said right half of said device;

a support plate, said support plate having an upper surface and a lower surface, said upper surface of said support plate being attached to said lower surface of said support member, said support plate having an aperture therein, said aperture in said support plate being aligned with said one hole located at the center of said frame, said aperture being threaded; and, a pivot ball, said pivot ball having a threaded rod embedded therein, said threaded rod being engaged with said aperture in said support plate whereby allowing said pivot ball to be screwed tightly against said lower surface of said support plate.

2. The device according to claim 1 wherein said first handle further comprises:

a first bracket, said first bracket being elongate and having upturned ends, said first handle being fixed between said upturned ends; and, means for fixing said first handle between said upturned ends of said first bracket.

3. The device according to claim 2 wherein said means for fixing said first handle comprises a nut and bolt arrangement.

4. The device according to claim 1 wherein said second handle further comprises:

a second bracket, said second bracket being elongate and having upturned ends, said second handle being fixed between said upturned ends; and, means for fixing said second handle between said upturned ends of said second bracket.

5. The device according to claim 4 wherein said means for fixing said second handle comprises a nut and bolt arrangement.

6. The device according to claim 1 further comprising:

a third handle, said third handle having a third mounting peg, said third mounting peg for engaging another of said at least two holes located in the left half of said device; and, a fourth handle, said fourth handle having a fourth mounting peg, said fourth mounting peg for engaging another of said at least two holes located in the right half of said device.

7. The device according to claim 6 wherein said third handle further comprises:

a third bracket, said third bracket being elongate and having upturned ends;

a first handle extension, said first handle extension being attached to said upturned ends of said third bracket, said first handle extension extending beyond one of said upturned ends in a horizontal plane, said third handle being attached to said first handle extension; and, a first cradle, said first cradle being attached to said first handle extension directly above said third bracket.

8. The device according to claim 7 wherein said third handle is connected to said first handle extension at an angle of 120° with respect to said first handle extension.

9. The device according to claim 6 wherein said fourth handle further comprises:

a fourth bracket, said fourth bracket being elongate and having upturned ends;

a second handle extension, said second handle extension being attached to said upturned ends of said fourth bracket, said second handle extension extending beyond one of said upturned ends of said fourth bracket in a horizontal plane, said fourth handle being attached to said second handle extension; and, a second cradle, said second cradle being attached to said second handle extension directly above said fourth bracket.

10. The device according to claim 9 wherein said fourth handle is connected to said second handle extension at an angle of 120° with respect to said second handle extension.

11. The device according to claim 6 further comprising a fifth handle, said fifth handle having a fifth mounting peg, said fifth mounting peg being rotatably engaged with said one hole located in the center of the circle formed by said frame.

12. The device according to claim 11 wherein said fifth mounting peg is engaged with said one hole located in the center of the circle formed by said frame such that said fifth handle forms an angle of 45° with respect to a horizontal plane.

* * * * *